United States Patent [19]

Busch, Jr.

[11] 4,083,618

[45] Apr. 11, 1978

[54] SAFETY ENCLOSURE

[76] Inventor: Francis W. Busch, Jr., Luther Dr., Southbury, Conn. 06488

[21] Appl. No.: 803,628

[22] Filed: Jun. 6, 1977

[51] Int. Cl.[2] ..... H01R 13/54

[52] U.S. Cl. ..... 339/75 P; 339/36

[58] Field of Search ..... 339/36, 43, 44 R, 39, 339/75 P, 82, 91 R, 103 R, 106, 107

[56] References Cited

U.S. PATENT DOCUMENTS

| | | | |
|---|---|---|---|
| 2,462,756 | 2/1949 | Leopold | 339/75 P |
| 2,934,591 | 4/1960 | Tiikkainen | 339/36 X |
| 3,639,886 | 2/1972 | Drapkin | 339/36 |
| 3,775,729 | 11/1973 | Casper | 339/75 P |

*Primary Examiner*—Roy Lake
*Assistant Examiner*—E. F. Desmond

[57] ABSTRACT

A safety enclosure comprises a hollow thin flexible insulator having a vertical rectangular front panel with top and bottom horizontal edges and oppositely disposed vertical side edges. The insulator has top and bottom walls and oppositely disposed side walls. The top wall is integral with the panel and extends rearwardly and upwardly from the top edge. The bottom wall is integral with the panel and extends rearwardly and downwardly from the bottom edge. Each side wall is integral with the top and bottom walls and the panel and extends rearwardly and outwardly from the panel. The panel has a central opening. Each side wall has upper and lower horizontal elongated slots completely spanning the side wall and disposed respectively slightly above and slightly below said opening. The upper and lower slots of one side wall are horizontally aligned with the upper and lower slots respectively of the other side wall. The portion of the insulator including the top wall and the portions of side walls and panel between the top wall and the upper slots constitutes an upper section. The portion of the insulator including the bottom wall and the portions of the side walls and panel between the bottom wall and the lower slots constitutes a lower section. The upper section is hingedly secured to the panel by a first elongated horizontal living hinge defined by a first horizontal line in the panel interconnecting the adjacent ends of the upper slots. The lower section is hingedly secured to the panel by a second elongated horizontal living hinge defined by a second horizontal line in the panel interconnecting the adjacent ends of the lower slots. The upper section has first slotted means for detachably receiving a male plug and cord connected thereto. The lower section has second slotted means for detachably receiving a male plug and cord connected thereto. An elongated horizontal insulator cylinder has a central horizontal bore. One end of the cylinder is secured to the rear of the panel with the bore aligned with the central hole, said cylinder extending rearwardly from the panel.

6 Claims, 8 Drawing Figures

FIG. 1
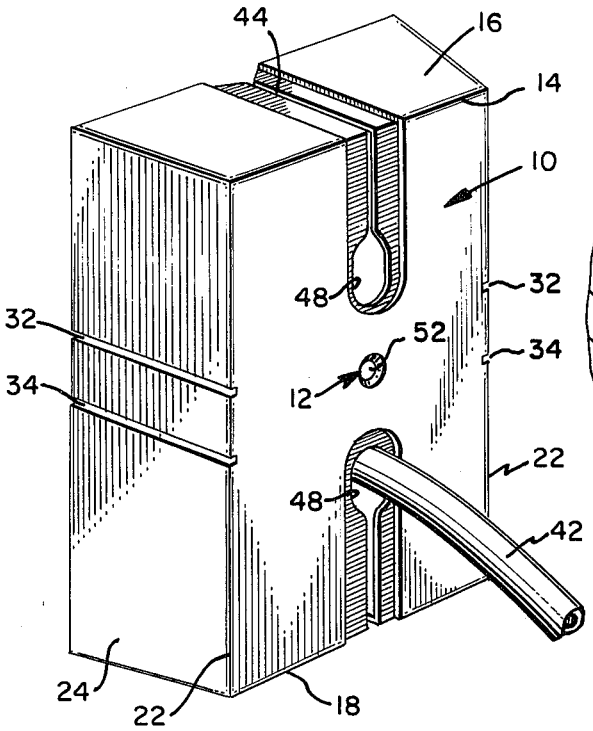
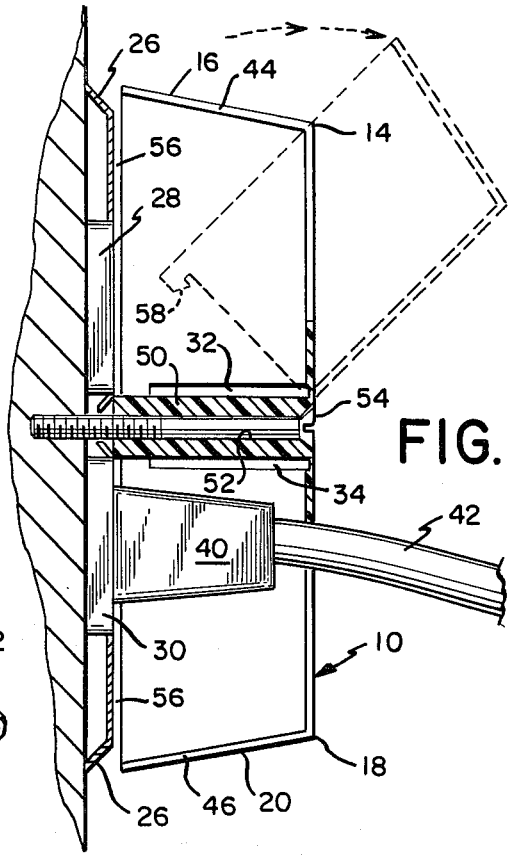
FIG. 4
FIG. 2
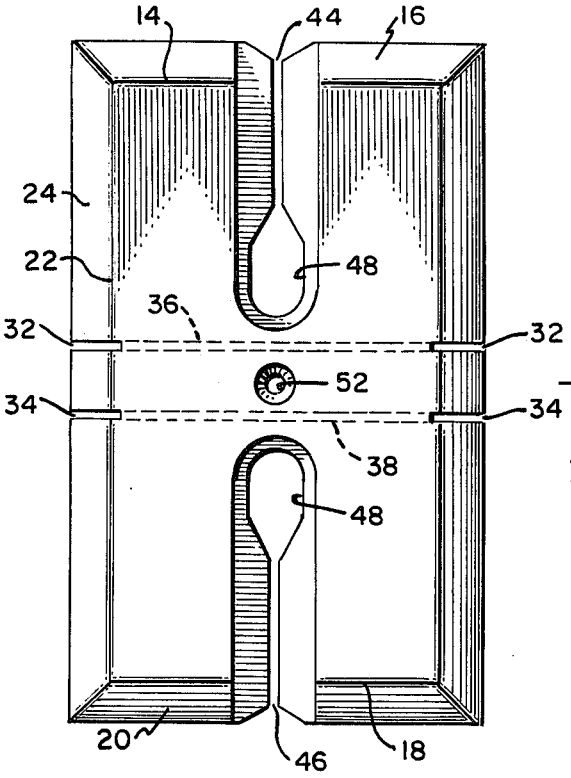
FIG. 3
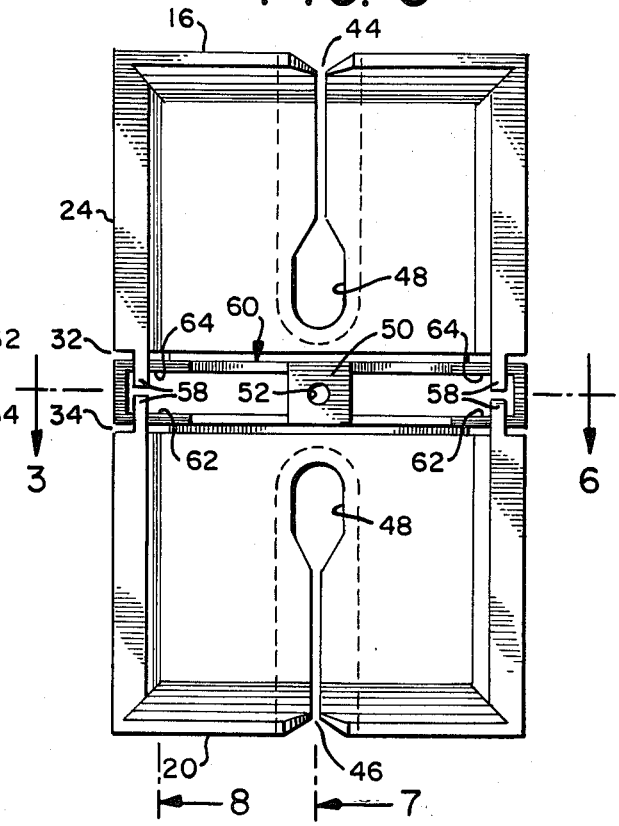

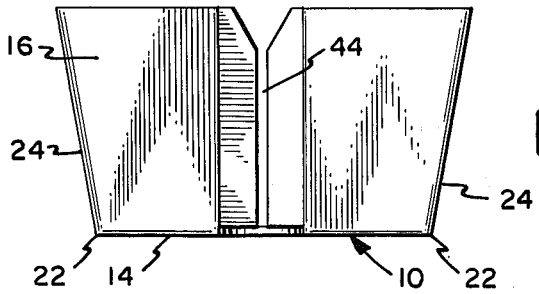
FIG. 5
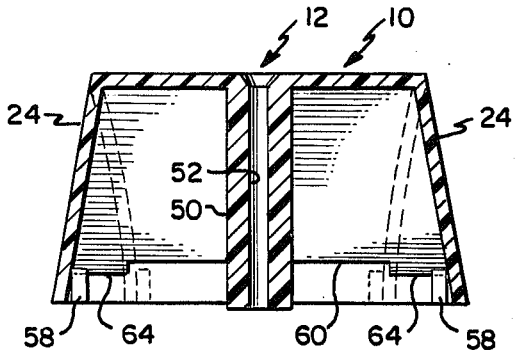
FIG. 6
FIG. 7
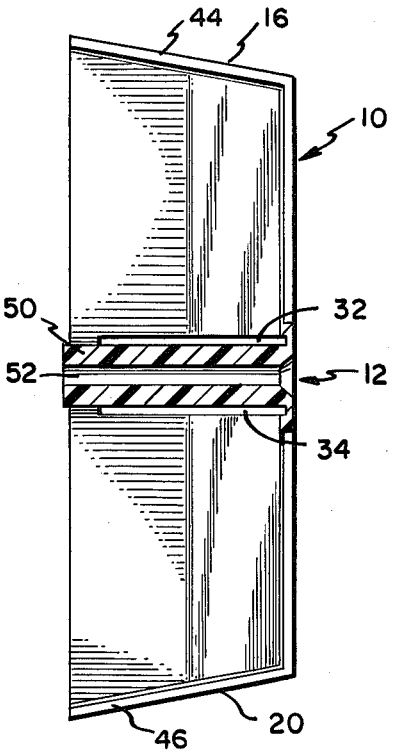
FIG. 8
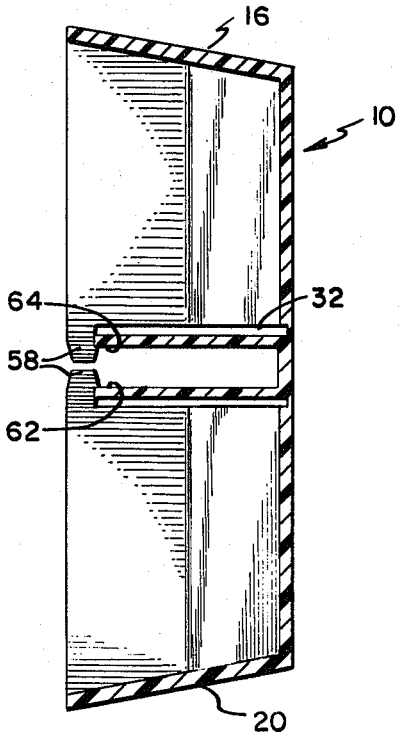

SAFETY ENCLOSURE

PRIOR ART STATEMENT

Safety enclosures of various types deemed to be the most significant prior art are shown in the following U.S. Pat. Nos. 2,569,037; 3,067,402; 3,601,757; 3,656,083; 3,775,729; 3,811,104; and 3,955,870.

SUMMARY OF THE INVENTION

Safety enclosures are covers for electrical wall or floor outlets which releaseably hold one or more extension cord plugs in corresponding plug receiving outlets in such manner as to prevent accidental unplugging of such plugs by a child tugging on the cord.

It is a primary object of this invention to provide an inexpensive safety enclosure easily installed and removed from an electrical wall or floor outlet which easily operated by adults and essentially inoperable by small children or pets.

Another object is to provide a safety enclosure which is characterized by a one piece durable construction and which protects the wall or floor outlet both when in use and when not in use.

Yet another object is to provide a safety enclosure using a manually operable locking mechanism which can only be unlocked by a combination of squeezing and folding forces applied simultaneously to the enclosure, whereby adults can operate the mechanism without difficulty while young children who cannot master the application of the simultaneous forces cannot unlock the enclosure.

In accordance with the principles of this invention, the safety enclosure takes the form of a hollow thin flexible insulator having a vertical rectangular front panel with top and bottom horizontal edges and oppositely disposed vertical side edges. The insulator has top and bottom walls and oppositely disposed side walls, the top wall being integral with the panel and extending rearwardly and upwardly from the top edge, the bottom wall being integral with the panel and extending rearwardly and downwardly from the bottom edge. Each side wall is integral with the top and bottom walls and the panel and extends rearwardly and outwardly from the panel.

The panel has a central opening. Each side wall has upper and lower horizontal elonaged slots completely spanning the side wall and disposed respectively slightly above and slightly below said opening, the upper and lower slots of one side wall being horizontally aligned with the upper and lower slots respectively of the other side wall. The portion of the insulator including the top wall and the portions of side walls and panel beween the top wall and the upper slots constitutes an upper section; the portion of the insulator including the bottom wall and the portions of the side walls and panel beween the bottom wall and the lower slots constitutes a lower section.

The upper section is hingedly secured to the panel by a first elongated horizontal living hinge defined by a first horizontal line in the panel interconnecting the adjacent ends of the upper slots. The lower section is hingedly secured to the panel by a second elongated horizontal living hinge defined by a second horizontal line in the panel interconnecting the adjacent ends of the lower slots.

The upper section has first slotted means for detachably receiving a male plug and cord connected thereto; the lower section has second slotted means for detachably receiving a male plug and cord connected thereto.

One end of an elongated horizontal insulator cylinder having a central horizontal bore is secured to the rear of the panel with the bore aligned with the central hole, said cylinder extending rearwardly from the panel. A horizontally elongated ribbed insulator member is aligned with the vertical rectangle and extends between the side walls, said member being integral with the cylinder and with the portions of the side walls subtended between the upper and lower slots. Each of the upper and lower sections has latch means secured to the inside of each side wall adjacent the corresponding aligned slots of the said each section and detachably securable with said member.

In use, the central screw holding the protective plate on the wall or floor outlet is removed while the plate remains in place. The enclosure is then placed over the plate with the bore of the cylinder aligned with the screw opening in the plate and the rear of the cylinder bearing against the plate. A longer screw is inserted in the bore from the outside of the panel and is screwed into the plate opening with the enclosure in registration with the plate. Typically, the outlet has upper and lower plug receiving receptables which are covered by the upper and lower sections respectively of the enclosure.

When the enclosure is so positioned, a user can normally close either or both sections and the corresponding latch means engage the member whereby the sections are locked closed. Either section can be unlocked when the user exerts an inwardly squeezing pressure on the opposite side walls whereby the corresponding latch means snap off the member and pull outward whereby the section swings outward about its living hinge.

When a section is unlocked, an extension cord plug can be inserted therein through the corresponding slotted means to engage the corresponding receptable. The section can then be locked into position and the plug is seated in the receptable and cannot be pulled out until the section is unlocked.

BRIEF DESCRIPTION OF THE DRAWINGS

FIG. 1 is a front perspective view of the invention.

FIG. 2 is a front view thereof.

FIG. 3 is a rear view thereof.

FIG. 4 is a vertical cross section taken along one side of the invention in use illustrating the unlocking action.

FIG. 5 is a top view thereof.

FIG. 6 is a horizontal cross section taken along line 6—6 in FIG. 3.

FIG. 7 is a vertical cross section taken along line 7—7 in FIG. 3.

FIG. 8 is a vertical cross section taken along line 8—8 in FIG. 3.

DETAILED DESCRIPTION OF PREFERRED EMBODIMENT

The safety enclosure shown in FIGS. 1–8 is a molded integral unit of plastic, as for example medium density polypropylene, which is an electrical insulator. The enclosure has a vertical rectangular front panel 10 with a central opening 12. The panel has a top horizontal edge 14 having a top wall 16 extending upwardly and rearwardly therefrom, a bottom horizontal edge 18 with a bottom wall 20 extending downwardly and rearwardly therefrom, and opposite vertical side edges 22. A side wall 24 extends outwardly and rearwardly from each side edge. Each side wall is integral with both top and bottom walls. The top, bottom and side walls have integral rear edges defining a vertical rectangle somewhat wider and longer than the front panel and parallel thereto. This rectangle is so sized as to be fitted over and around the cover plate 26 of an electrical wall outlet having an upper receptacle 28 and a lower receptable 30.

Each side wall has upper and lower horizontal slots 32 and 34 completely spanning each side wall and disposed respectively slightly above and slightly below opening 12. The upper slots of both walls are horizontally aligned and the lower slots of both walls are also horizontally aligned.

The portion of the enclosure including the top wall and the portions of the side walls and panel between the top wall and upper slots 32 constitutes an upper section hingedly secured to the remainder of the panel by a first elongated horizontal living hinge defined by a first horizontal line (shown dotted at 36 in FIG. 2) in the panel interconnecting the adjacent ends of upper slots 32.

The portion of the enclosure including the bottom wall and the portions of the side walls and panel between the bottom wall and lower slots 34 constitutes a lower section hingedly secured to the remainder of the panel by a first elongated horizontal living hinge defined by a second horizontal line (shown dotted at 38 in FIG. 2) in the panel interconnecting the adjacent ends of lower slots 34.

The lower section has slotted means for detachably receiving a male plug 40 and cord 42 connected thereto, this plug being removably inserted in receptable 30. The means includes a transverse horizontal slot 44 in the bottom wall centrally disposed communicating and connected to a vertical slot 46 in the panel, slot 46 terminating in an enlarged region 48 adjacent but below the line 38. Slots 44 and 46 are narrower than the cord and region 48 is slightly enlarged to accommodate the cord. The plug is larger than region 48.

The upper section has like slotted means reversed in position with respect to the means in the lower section as shown.

An elongated horizontal cylinder 50 of square cross section and having a central bore 52 is secured at one open end to the rear of the panel, with bore 52 aligned with opening 12, and extends rearwardly to a position slightly to the rear of the previously described vertical rectangle. A screw 54 extends from the front of the panel through opening 12 and bore 52 into the central threaded opening in the cover plate 26. The length of the cylinder is slightly larger than the depth of the rest of the enclosure to establish small clearance space 56. This space facilitates locking and unlocking as described below.

Each of the upper and lower sections has set in on the inside of each wall a latch or hook 58. The latches for the upper section extend downwardly below the hinge line 36 at each side wall and the latches for the lower section extend upwardly above the hinge line 38 at each side wall.

First and second elongated horizontal ribs 60 and 62 extend between opposite side walls and are integral with the top and bottom horizontal edges of the portions of the side walls subtended between the upper and lower slots as well as with cylinder 50. Rib portions adjacent each side wall have reduced shoulder regions shown at 64.

When a section is in locked position either with or without a plug and cord disposed therein, its latches hook onto the regions 64 of rib 60 for the upper section and rib 62 for the lower section. In order to unlock the section the user must press inwardly on both side wall until the latches snap off the rib and pull outwards to pivot the section outwardly about its living hinge, the upper section being swung downwardly, the lower section being swung upwardly.

I claim:

1. A safety enclosure comprising:

a hollow thin flexible insulator having a vertical rectangular front panel with top and bottom horizontal edges and oppositely disposed vertical side edges, said insulator having top and bottom walls and oppositely disposed side walls, the top wall being integral with the panel and extending rearwardly and upwardly from the top edge, the bottom wall being integral with the panel and extending rearwardly and downwardly from the bottom edge, each side wall being integral with the top and bottom walls and the panel and extending rearwardly and outwardly from the panel;

said panel having a central opening, each side wall having upper and lower horizontal elongated slots completely spanning the side wall and disposed respectively slightly above and slightly below said opening, the upper and lower slots of one side wall being horizontally aligned with the upper and lower slots respectively of the other side wall, the portion of the insulator including the top wall and the portions of side walls and panel between the top wall and the upper slots constituting an upper section, the portion of the insulator including the bottom wall and the portions of the side walls and panel between the bottom wall and the lower slots constituting a lower section;

the upper section being hingedly secured to the panel by a first elongated horizontal living hinge defined by a first horizontal line in the panel interconnecting the adjacent ends of the upper slots, the lower section being hingedly secured to the panel by a second elongated horizontal living hinge defined by a second horizontal line in the panel interconnecting the adjacent ends of the lower slots;

the upper section having first slotted means for detachably receiving a male plug and cord connected thereto, the lower section having second slotted means for detachably receiving a male plug and cord connected thereto;

and an elongated horizontal insulator cylinder having a central horizontal bore, one end of the cyliner being secured to the rear of the panel with the bore aligned with the central hole, said cylinder extending rearwardly from the panel.

2. The enclosure of claim 1, wherein the top, bottom and side walls have integral rear edges defining a vertical rectangle somewhat wider and longer than the panel and parallel to the panel.

3. The enclosure of claim 2, wherein the end of the cylinder remote from the panel extends somewhat to the rear of the vertical rectangle.

4. The enclosure of claim 3 provided with manually operable latching means for separately and detachably locking each section in position.

5. The enclosure of claim 4, wherein the latching means includes a horizontally elongated member aligned with the vertical rectangle and extending between the side walls, said member being integral with the cylinder and with the portions of the side walls subtended between the upper and lower sots.

6. The enclosure of claim 5, wherein the latching means includes separate latch means secured to the inside of each side wall adjacent the corresponding aligned slots of the said each section and detachably securable with said member.

* * * * *